United States Patent [19]

Zepper

[11] 4,083,562

[45] Apr. 11, 1978

[54] GAME GOAL WITH FLEXIBLE OBJECT IMPACTING CURTAIN

[76] Inventor: Allen O. Zepper, 5255 Irondale Rd., Mounds View, Minn. 55112

[21] Appl. No.: 691,132

[22] Filed: May 28, 1976

[51] Int. Cl.[2] ..... A63B 63/00

[52] U.S. Cl. ..... 273/127 B; 273/1 B

[58] Field of Search ..... 273/1 B, 26 A, 181 R, 273/181 A, 181 F, 181 J, 181 K, 127 R, 127 B, 85 R, 85 A–85 F

[56] References Cited

U.S. PATENT DOCUMENTS

| | | | |
|---|---|---|---|
| 331,756 | 12/1885 | Baker | 273/127 R |
| 1,545,772 | 7/1925 | Jacobs | 273/181 A |
| 1,788,803 | 1/1931 | MacGeorge | 273/181 R |
| 2,077,343 | 4/1937 | Oakes et al. | 273/127 R |
| 2,256,555 | 9/1941 | Foltin et al. | 273/127 R |
| 2,823,034 | 2/1958 | Binghan, Jr. | 273/26 A |
| 3,466,049 | 9/1969 | Fox et al. | 273/181 A |

*Primary Examiner*—Richard C. Pinkham
*Assistant Examiner*—T. Brown
*Attorney, Agent, or Firm*—H. Dale Palmatier

[57] ABSTRACT

A goal supportable on a horizontal playing surface such as an outdoor ice hockey rink. The goal has a rear wall and a forwardly open and unobstructed mouth. A see-through vertical impact curtain is suspended from its upper end within the goal and is spaced nearer the rear walls than the open mouth of the goal. The impact curtain is of a limp, heavy, momemum-absorbing, material such as chain link fencing which when impacted by a hockey puck or object will bend in one direction and be substantially stiff and resistant to flexing in a second direction transverse to the one direction. The momentum of hockey pucks or the like shot into the goal is absorbed by the curtain, and the pucks are deposited on the playing surface within the goal without rebounding or rolling out of the goal.

9 Claims, 4 Drawing Figures

10
12
12.1
12.2
12.3
12.4
12.5
14
14.1
14.2
14.3
14.4
14.5
14.6
14.7
14.8
16
18
20
22
24
24.1
24.2
24.3
26
30
40
40.1

GAME GOAL WITH FLEXIBLE OBJECT IMPACTING CURTAIN

BACKGROUND OF THE INVENTION

Non-professional ice hockey has become an increasingly popular participation sport, and a goodly portion of ice hockey rinks in the northern tier of states in the United States are out-of-doors. The nets or goals which are employed with out-of-door rinks may have wood or metal framing supporting a fabric mesh or netting forming the goal enclosure. Although the goals are removable from their positions so that the surface of the ice in the goal area may be repaired and so that the goals may be stored during the summer time, the goals for out-of door rinks ordinarily are left in place during the hockey season and suffer greatly not only from the natural elements but from the results of hard play. In order to provide a sturdy, weather-resistant goal, I have built and tested a goal which employs a tubular, rigid metal framework bearing tautly stretched chain link wire fabric of the type generally used for commercial fencing. Although this goal has proven to be sturdy and weather resistant, it has been found that pucks, when shot into the goal, tend to rebound easily from the chain link surfaces and often escape from the goal. This has produced a dual problem. Firstly, since hockey pucks are often shot with great velocity into the net, with often as many as eleven hockey players congregating about the net and obstructing vision, it is often difficult to tell when a goal has actually been scored. Secondly, although the goalie may appropriately protect himself from injury from flying pucks shot from in front of the goal, the rebound of pucks, which is then from the rear of the goalies, may present a potentially hazardous situation.

Those familiar with the game of hockey will understand that a hockey goal may not be provided with a ramp extending across the front of the goal to prevent the escape of hockey pucks, nor with impact cushioning netting obstructing the mouth of the goal, since both the ramp and the netting would clearly and dangerously interfere with movements of the goalie and other players during fierce play about the goal. The mouth of the goal must be unobstructed.

A sturdy and weather-resistant goal useful for outdoor hockey rinks, which would have an unobstructed mouth and yet prevent the rebounding or rolling out of pucks from the goal would be highly desirable.

SUMMARY OF THE INVENTION

The present invention provides a forwardly open goal which is supportable on a horizontal playing surface such as an outdoor hockey rink. The goal comprises a frame supportable on a horizontal playing surface, and netting supported by the frame to define side and rear walls of the goal. The goal has a forwardly open and unobstructed mouth lying in a vertical plane. A vertical, see-through impact curtain is suspended from its upper end transversely within the goal, and is spaced nearer the rear wall than the the open mouth. The curtain hangs freely downwardly within the goal to a level spaced above and out of contact with the horizontal playing surface. The momentum of a hockey puck which is shot into the goal is absorbed by the curtain, and the puck is deposited on the playing surface flatly within the goal without rebounding or rolling out of the goal. The netting forming those walls of the goal which extend forwardly of the impact curtain desirably are of tautly supported wire mesh, the walls thus deflecting pucks which may strike them into the impact curtain.

In the preferred embodiment, the goal comprises a rigid, tubular metal frame with rigidly supported wire mesh forming the side, top and rear walls of the goal, the impact curtain hanging generally parallel to the plane of the open goal mouth and spaced horizontally at its bottom end nearer the rear of the goal than the mouth of the goal. The impact curtain is of a limp, heavy, momentum-absorbing, see-through material such as chain link fencing, and is disposed in the goal in a manner such that the weight of the curtain alone causes it to hang downwardly limply in a general vertical plane.

The wire mesh forming the top, rear and side walls of the goal is desirably made of heavy gauge steel wire, desirably 9 gauge or heavier, and is of a type known to the art and often used as commercial fencing. The side walls of the goal desirably are formed of separate metal mesh panels at least partially bounded by metal struts or secondary frames which in turn are fastened rigidly to the goal frame. The top and rear walls of the goal desirably are formed of a single metal mesh panel bounded at its bottom and top and for a portion of its length along its sides by metal struts which in turn are fastened to the goal frame.

It has been surprisingly found that pucks shot into a goal of the invention do not roll out of the goal, but rather land generally flatly on the ice within the interior of the goal.

DETAILED DESCRIPTION OF THE PREFERRED EMBODIMENT

Figures 1, 2, 3, 4:
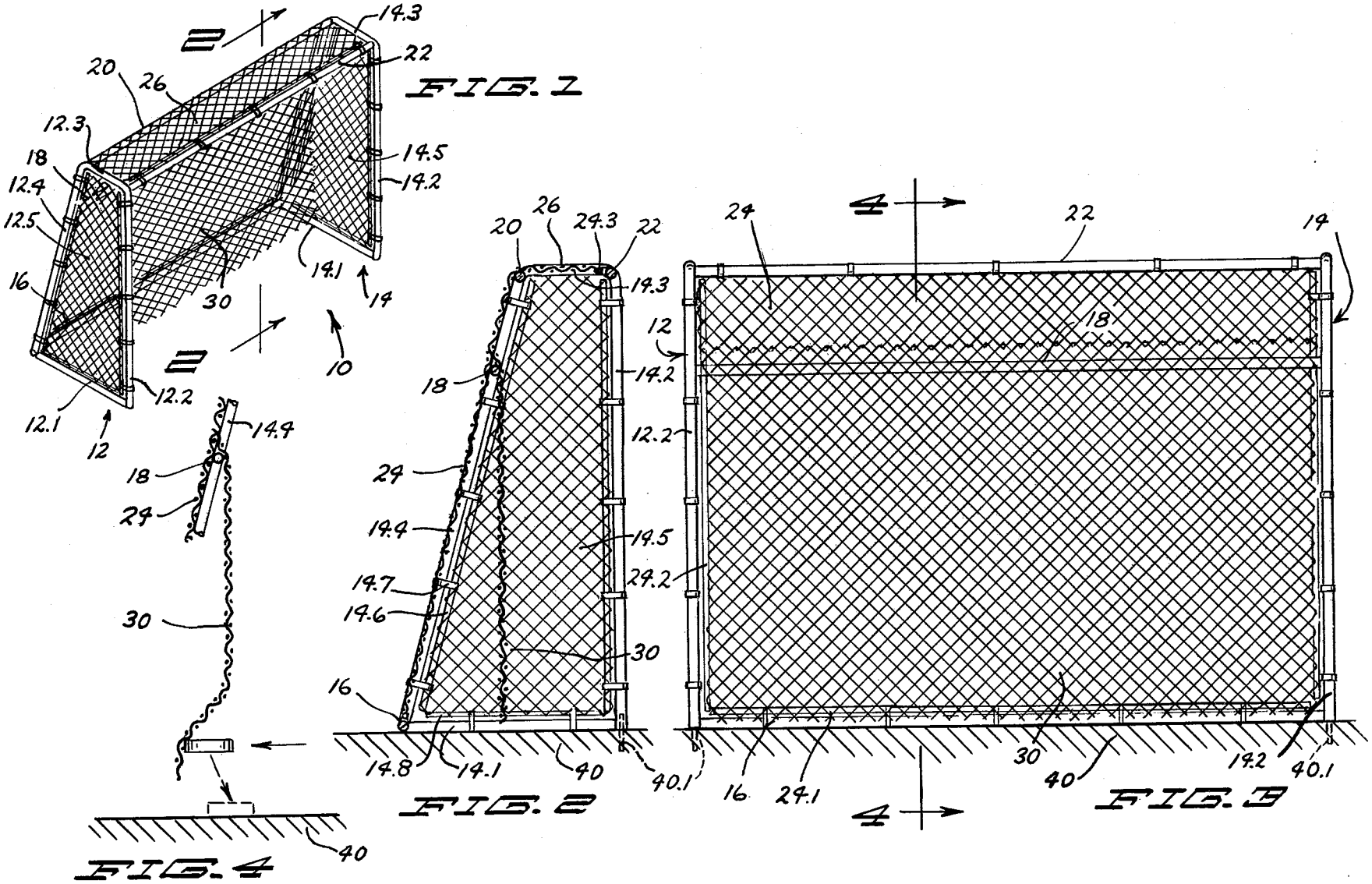
FIG. 1 is a perspective view of the goal of the invention.
FIG. 2 is a cross sectional view taken along line 2—2 of FIG. 1.
FIG. 3 is a front view of the goal of FIG. 1.
FIG. 4 is a diagrammatic view of the impact curtain of the invention as the same is struck by a hockey puck, and is taken generally along line 4—4 of FIG. 3.

Referring first to FIG. 1, the frame of the invention is designated generally as 10 and comprises side frame members 12, 14 and transverse frame members 16, 18, 20 and 22. The side and transverse frame members may be made of tubular metal such as steel, and may have an outer diameter in the range of, for example, 1½inches. The side frames 12, 14 are generally trapezoidal in shape, and each comprises a rearwardly extending bottom segment 12.1, 14.1, and at right angles thereto, upright front frame segments 12.2, 14.2. Top segments 12.3, 14.3 extend rearwardly from the upper ends of the front segments. Downwardly and rearwardly extending back segments 12.4, 14.4 extend between the rearward ends of the top and bottom segments of each side frame. Desirably, the front, top and back segments of each side frame are made as an integral unit by appropriately bending a length of tubing into a generally inverted U-shaped configuration, following which the bottom segment is welded between the lower ends of the front and rear segments. The transverse frame members 16, 18, 20 and 22 are then welded to the respective side members, as shown best in FIG. 1. The transverse member 18, as is shown, connects the back frame members 12.4, 14.4 at a point adjacent to but spaced from their upper ends. The transverse frame members are parallel to one another, and desirably are of equal length, although if desired the side frames may be made to converge rearwardly slightly primarily for the sake of appearance.

Separate metal mesh panels 12.5, 14.5 are mounted within the segments of the side frame members by means of elongated struts or secondary frames, of which one is shown as 14.6 in FIG. 2. As noted above, the wire mesh employed for the goal enclosure is desirably of 9 gauge steel wire or heavier, and is of the type commonly employed for commercial fencing in the United States. Fencing of this type is comprised of a series of generally parallel wires, each wire linked to adjacent wires and each having a generally helical, flattened configuration. The wires of chain link metal mesh of this type appear to run on the diagonal, as shown in FIG. 2, whereas in fact the individual wires of the mesh are generally vertical or horizontal, as will be subsequently described in more detail. The struts, exemplified by strut 14.6 in FIG. 2, are threaded through the helical bends of the wire, and the struts themselves are then clamped to the side frame members (for example, 14.4 in FIG. 2) by rigid metal clips as exemplified by 14.7 in FIG. 2, each clip encircling both the side frame segment and the strut. In this manner, the wire mesh may be stretched tautly from front to rear across the side frame members with the stiffness of the generally vertical individual wires of the mesh serving to maintain the panel in a flattened, unbowed orientation from bottom to top. To further strengthen the side panels, rearwardly extending bottom 14.8 and top struts may be employed to insure that the wire mesh does not become bowed out from the bottom and top frame segments 14.1, 14.3 during repeated use.

Rear and top walls 24, 26 are desirably formed of a single panel of heavy wire mesh, as described above. A strut 24.1 (FIG. 3) is threaded through the wire mesh at its bottom edge and is clipped to the transverse frame member 16. Side struts 24.2, which extend substantially the entire height of the back frame segments 12.4, 14.4, are provided along both sides of the mesh panel 24. The panel passes over the transverse frame member 18 and is bent forwardly over the transverse frame member 20, extending forwardly for attachment, by means of a strut 24.3, to the top front transverse frame member 22, thereby forming the top wall of the goal. The side edges of the top panel 26, I have found, need not be fastened by struts to the top frame segments 12.3, 14.3.

A vertical impact curtain 30 is suspended from its upper end within the goal, and hangs generally parallel to the open mouth of the goal. The impact curtain 30 is of see-through material; that is, it does not unduly obstruct the vision, for example, of a hockey player who, positioned in front of the goal, can see through the curtain and observe the puck and hockey action taking place to the immediate rear of the goal. Wire mesh of the type described above has been found suitable for this purpose, although any reasonably heavy and limp mesh material could be employed, such as a mesh made from interlocking metal rings or the like. In addition to being of a see-through material, the impact curtain must have sufficient weight to hang generally straight downwardly of its own weight from its connection along its upper end to the goal, and must also be of sufficiently limp material as to absorb the momentum of an impinging hockey puck.

When the cutain 30 is made of the above-described wire mesh, the elongated, flattened helical individual wires should run generally horizontally so that the curtain may yield vertically and may be deformed along generally horizontal bend lines (See FIG. 4) when struck by a hockey puck. The horizontal orientation of the individual wires also provides the curtain with stiffness to prevent it from bending along vertical bend lines. As thus described, it will be understood that the curtain may be lifted easily, as by the goal tender's hockey stick, to permit retrieval of a puck from behind the curtain. The ability of the curtain to thus easily yield vertically is an important feature of the invention.

Desirably, the upper edge of the curtain is woven into the rear wall 24 of the goal, as by the use of a flattened, helical wire as described above, along a line slightly above the position of the transverse frame member 18. From its connection to the rear wall 24, the curtain extends forwardly slightly over the frame member 18, and then hangs loosely down toward the horizontal playing surface upon which the goal is placed. The vertical length of the curtain is such that its lower end approaches but does not contact the playing surface, and the vertical edges of the curtain are spaced inwardly slightly from the side walls 12.5, 14.5 of the goal. The horizontal playing surface (designated 40), as will be understood, lies in a plane defined by the bottom edges of the side frame members. In this manner, the impact curtain is supported within the goal only at its top, and hangs downwardly freely and limply within the goal. The bottom edge of the curtain should be spaced from the playing surface by not more than about 1½ inches, and desirably approaches more closely to the playing surface. As noted above, the bottom edge of the impact curtain is spaced well within the goal enclosure, and desirably is nearer the rear than the front of the goal. Desirably, the bottom edge of the curtain is spaced rearwardly from the open mouth of the goal by a distance of approximately two thirds of the front-to-rear goal dimension.

The mouth of the goal, for regulation hockey play, should be 6 feet in width and 4 feet in height. The front-to-rear dimension of the goal at its bottom may typically be approximately 23 inches, and the front-to-rear dimension of the top wall may be on the order of 11 inches. The impact curtain typically may be attached to the rear wall 24 of the goal at a level of, for example, 12 inches or less from the top wall 26, the impact curtain thus having a vertical dimension of at least about three fourths of the height of the open mouth of the goal. Typically, the side edges of the curtain may be spaced inwardly of the side walls 14.5, 12.5 by a distance of approximately ½ inch, and the curtain may extend downwardly to typically ½ inch from the playing surface.

In order to retain the goal in place on a hockey rink, the vertical tubular frame segments 12.2, 14.2 may be downwardly open, and readily borken pegs or dowels 40.1 may be inserted in the open lower ends and extend downwardly into appropriately positioned holes in the ice. The pegs may be of wood or other rather easily broken material so that the goal itself may be safely broken loose from the playing surface in the event of extremely rough play around the goal.

It will now be evident that the open, unobstructed mouth of the goal permits hockey pucks to be shot therein from generally any position forwardly of the goal mouth. When a puck impacts against the curtain 30, the curtain yields upwardly, as shown in FIG. 4, thereby absorbing the puck's momentum and permitting the puck to fall flatly against the surface of the ice. Should a puck be shot in such a manner as to first contact the top wall or one of the side walls of the goal forwardly of the impact curtain, the rather taut nature of these walls has been found to deflect the puck thence inwardly against the impact curtain. Because the impact curtain may yield vertically with ease, it may easily be lifted up by a hockey player to retrieve pucks which may have become trapped behind the curtain. Because of the close approach of the bottom edge of the curtain to the playing surface, pucks which are shot along the ice into the goal contact the lower edge of the curtain and lose momentum, the pucks then slipping behind the curtain. Any rebound of such pucks from the back wall 24 or frame members causes the puck to again impact against the curtain from the rear.

During actual testing of a goal of the type depicted in the drawing, in which players skilled in the game of hockey continuously shot pucks into the goal, over 300 such shots were taken without escape of a single puck from within the goal interior. For reasons not completely understood, the impact curtain of the invention appears to cause pucks to be deposited flatly upon the ice within the goal interior so that the pucks do not roll or bounce out of the goal. This is an important feature of the invention, since it is often impossible in the heat of fast hockey action with prior hockey goals to determine whether a goal had actually been made. It appears that hockey pucks, when shot into a goal, are ordinarily in a generally horizontal configuration as shown in FIG. 4 and often spin rapidly about vertical axes passing through their centers; this leads me to believe that the impact curtain, by yielding vertically as shown in FIG. 4, permits the puck to retain its generally horizontal configuration so that it drops flatly onto the ice without rolling.

Thus, I have provided a sturdy, weather-resistant goal which not only has an open and safely unobstructed mouth, but which also is capable of absorbing the momentum of pucks shot therein to thereby prevent rebound. My goal can be easily and inexpensively fabricated through the use of tubular frame members and pre-assembled side and rear metal mesh panels. The unobstructed mouth of the goal provided by the rearward spacing of the impact curtain permits free movement of goal tenders about their position, and avoids entanglement of sticks or skates with the goal.

While I have described a preferred embodiment of the present invention, it should be understood that various changes, adaptations, and modifications may be made therein without departing from the spirit of the invention and the scope of the appended claims.

What is claimed is:

1. A forwardly open goal supportable on a horizontal playing surface such as an outdoor hockey rink or the like and comprising a frame and netting supported by the frame to define side and rear walls of the goal, the goal having a forwardly open and unobstructed mouth, and a vertical metal mesh impact curtain suspended from its top transversely within the goal and spaced well rearwardly of the open mouth, the metal mesh being freely flexible in one direction and being stiff and resistant to flexing in a second direction transverse to said one direction, the curtain hanging freely downwardly within the goal to a level approaching but spaced above and out of contact with the horizontal playing surface, the spacing between the impact curtain and the goal mouth being significantly less than the height of the impact curtain from top to bottom, and the curtain being of see-through, metal mesh which is yieldable and vertically swingable, whereby the momentum of hockey pucks or the like shot into the goal is absorbed by the curtain and the pucks are deposited on the playing surfaces within the goal without rebounding out of the open mouth.

2. The goal of claim 1 in which the netting forming at least the sidewalls of the goal forwardly of the curtain is substantially stiff and rigid and is supported tautly by the frame so as to cause pucks or the like which strike such walls within the goal to be deflected into the curtain.

3. The goal of claim 1 in which the rear wall of the goal extends forwardly and upwardly, and wherein the wire mesh impact curtain is attached at its upper end to the rear wall adjacent the top of the latter, the impact curtain being entirely swingable about its upper end and rearwardly toward the rear wall of the goal.

4. The goal of claim 3 wherein the walls of the goal are of see-through metal mesh, and wherein the top edge of the impact curtain is woven into the rear wall of the goal.

5. The goal of claim 1 in which the netting comprises a series of metal mesh panels tautly supported and at least partially bounded by supporting struts, and wherein the struts are rigidly fastened to the frame of the goal to provide separate side and rear walls.

6. The goal of claim 1 wherein the goal frame comprises a pair of generally trapezoidally shaped tubular metal side frames each having frame segments at right angles to each other which form a rearwardly extending bottom frame segment and an upright front frame segment, respectively, the remaining segments of each side frame providing a rearwardly extending top segment and a downwardly and rearwardly extending back segment respectively, and transverse frame members rigidly connecting the side frames at at least a top corner and a bottom rear corner, respectively, of the side frames.

7. A forwardly open goal supportable on a horizontal playing surface such as an outdoor hockey rink or the like, the goal comprising a frame including a pair of generally trapezoidally shaped tubular metal side frames each having frame segments at right angles to each other forming a rearwardly extending bottom frame member and an upright front frame member, respectively, the side frames being joined by transverse frame members to provide a forwardly-open enclosure, metal mesh panels supported and at least partially bounded by metal struts at their edges, the struts being attached to frame members of the goal with the metal mesh panels being tautly positioned to form side walls and a forwardly and upwardly inclined rear wall of the goal, the goal having a forwardly open and unobstructed mouth, and a vertical impact curtain flexible in one direction and stiff and resistant to flexing in another direction and suspended from its top transversely within the goal and hanging freely downwardly to a level approaching but spaced above and out of contact with the horizontal playing surface, the impact curtain being of see-through, metal mesh which is vertically yieldable, the curtain being attached at its top to said forwardly and upwardly inclined rear wall of the goal at a distance from the playing surface which is at least three-fourths of the height of the goal, whereby the momentum of a hockey puck shot into the goal is absorbed by the impact curtain, and the puck is deposited flatly on the playing surface within the goal without rebounding or folling out of the goal.

8. A forwardly open goal supportable on a horizontal playing surface such as an outdoor hockey rink or the like and comprising a frame and netting supported by the frame to define sidewalls and a forwardly and upwardly inclined rear wall, the netting in the sidewall being stiff to resist flexing, and the goal also having a forwardly open and unobstructed mouth, a vertical impact curtain to extend in horizontal and vertical directions to traverse substantially the entire interior of the goal, the impact curtain being formed of metal wire mesh which is flexible in one direction and is stiff to resist flexing in the other direction transversely of said one direction, the metal mesh having flattened helical wires extending in similar directions along each other to obtain such flexibility and stiffness, the impact curtain hanging freely downwardly within the goal to a level approaching the lowermost portion of the frame so as to be out of contact with the horizontal playing surface, the spacing between the impact curtain and the goal mouth being significantly less than the height of the impact curtain from top to bottom, and the curtain being of seethrough metal mesh which is yieldable and vertically swingable, whereby the momentum of hockey pucks shot into the goal is absorbed by the curtain and the pucks drop onto the playing surface within the goal without rebounding out of the open mouth.

9. The goal of claim 8 and the upper portion of the rear wall being disposed closer to the open mouth than the lower portion thereof, the impact curtain being attached to the upper portion of said rear wall and the lower portion of the impact curtain being swingable rearwardly toward the lower portion of the rear wall, the side and rear walls of the goal being stiff to resist flexing and being visually pervious.

* * * * *